US005813278A

United States Patent [19]

Schabdach et al.

[11] Patent Number: 5,813,278

[45] Date of Patent: Sep. 29, 1998

[54] PROJECTILE GRENADE LAUNCHING SYSTEM TESTER

[75] Inventors: Paul G. Schabdach, Churchville; Irving F. Barditch, Baltimore, both of Md.

[73] Assignee: The United States of America as represented by the Secretary of the Army, Washington, D.C.

[21] Appl. No.: 700,333

[22] Filed: Aug. 2, 1996

[51] Int. Cl.[6] ..... G01L 5/14

[52] U.S. Cl. ..... 73/167

[58] Field of Search ..... 340/635, 636; 324/433; 320/48; 73/167

[56] References Cited

U.S. PATENT DOCUMENTS 4,020,414 4/1977 Paredes ..... 324/433

5,050,501 9/1991 Barditch et al. ..... 102/293

5,614,807 3/1997 Duley ..... 320/DIG. 21

FOREIGN PATENT DOCUMENTS 107176 5/1986 Japan ..... 340/636

*Primary Examiner*—Diego F. F. Gutierrez
*Assistant Examiner*—Willie Morris Worth
*Attorney, Agent, or Firm*—Ulysses John Biffoni; Edward L. Stolarun

[57] ABSTRACT

A projectile grenade launching system tester, comprising a battery, a female jack to receive voltage from a grenade launcher, a plurality of operational amplifiers to receive constant current from the battery and to receive firing voltage from the grenade launcher through the female jack, a plurality of opto couplers to complete circuits should the voltage from the grenade launcher be greater than 0.5 volts, a plurality of light emitting diodes to indicate by lighting that greater than 0.5 volts is being received and a push button switch to open the circuit and permit resetting of the tester.

17 Claims, 2 Drawing Sheets

PROJECTILE GRENADE LAUNCHING SYSTEM TESTER

GOVERNMENT INTEREST

The invention described herein may be manufactured, used and licensed by or for the United States Government.

BACKGROUND OF THE INVENTION

The military has fielded vehicles that have incorporated multiple grenade launching systems to protect the personnel inside from enemy threats. The problem with these vehicles has been the inability of the crew to easily and quickly check the operability of the grenade launching system. There has never been a grenade system tester available that would indicate the actual current available for ignition of grenades.

In the past, a grenade was fired from the launcher by applying a sufficient voltage to the grenades terminals to produce approximately one ampere of current. This current flows through an internal electrical match of the grenade squib, to electrical ground. The match then ignites, which in turn ignites the charge of the grenade.

The voltage supplied to the system from the vehicle can be anywhere between 18 and 30 volts DC, but generally is between 24 and 28 volts DC.

The electrical characteristics of the internal electrical match needed for ignition are as follows: Below ¼ ampere results in a no fire condition, above ½ ampere results in an all fire condition, and between ¼ ampere and ½ ampere may or may not produce match ignition.

There are many factors involved in determining the current available for electrical match ignition. One factor may be a weak vehicle battery. Another factor may be faulty wiring (worn, open circuit, shorted or grounded) and most probably dirty contacts in the grenade launcher. As grenades are fired, the electrical contacts in the launch tube become dirty. This dirt is actually a buildup of carbon which tends to both increase the resistance in the system and shunt some of the current directly to ground. As this resistance in the system goes up the current available in the system for ignition goes down. A 15 ohm resistor is installed in each launch tube to limit current to a maximum of 2 amps. Using Ohm's law I=E/R, where I=current, E=voltage and R=resistance,

| | |
|---|---|
| I = 30 Volts DC/15 ohms | I = 2 amperes |
| I = 18 Volts DC/15 ohms | I = 1.2 amperes |

An all fire condition is ½ ampere or more of current.

| | |
|---|---|
| R = 30 Volts DC/.5 amperes | R = 60 ohms |
| R = 18 Volts DC/.5 amperes | R = 36 ohms |

An additional 36 to 60 ohms of resistance in the firing circuit will cause the current available for ignition to fall below the ½ ampere all fire level. When this happens a successful grenade firing may not occur.

| | |
|---|---|
| R = 30 Volts/.25 amperes | R = 120 ohms |
| R = 18 Volts/.25 amperes | R = 72 ohms |

An additional 72 to 120 ohms of resistance will bring the available current to below ¼ ampere or no fire level.

The prior art test unit was nothing more than an empty grenade case with an indicator lamp which lighted during grenade launcher tests, and two jacks for checking circuit continuity connected in parallel across the lamp.

This test set was unsatisfactory for testing the grenade launching system because it required at least two (2) people to operate the system and it did not indicate the actual circuit current available for grenade ignition.

Other test simulators tried substituting a ½ ampere fuse across the test electrical terminals. This was not suitable because the ½ ampere fuse would not blow due to the characteristics of the firing circuit, necessitating the use of a ¼ ampere fuse. This was not satisfactory because the ¼ ampere fuse shows 2.3 ohms to ground instead of the required 1 ohm. In addition, it is difficult to detect whether the fuse was good to start with and hard to detect when it was blown. A further detriment to the use of a fuse was that an ohm meter was required to check the continuity because of the visual problem. Another problem with the ¼ ampere fuse was that it could only be used once and that it gave the wrong current draw to the system and did not represent the current draw of an actual electrical match. Since the system will not work if a fuse is not available, a large supply of fuses must be maintained on hand. An 80 launch tube system would require 80 fuses to test and would only allow for testing each tube once.

The attempt to use a circuit breaker in place of a fuse was not feasible because a circuit breaker in this current range required too long a pulse to operate and would be of the wrong resistance reading. Other prior art test simulators utilizing an indicator meter were unsatisfactory because they did not indicate the actual current, but only indicated that a voltage was present. Such simulations required two (2) people to operate and made it extremely difficult to monitor more than one launch tube at a time since the meter must be continually watched to observe its movement indicting a fire pulse has been present.

An additional tester (U.S. Pat. No. 5,050,501) works quite well as a grenade simulator but does not give current availability information. The tester does not indicate below ¼ amp above ½ amp or current readings between ¼ and ½ amp. Thus, the tester may work when in fact an actual grenade may not.

The operability of a grenade launcher system is defined by the electrical characteristics of the squib of a grenade. The squib of a grenade is an electrical match. An electrical match has the following electrical characteristics: Below ¼ ampere of current is a no fire condition. Above ½ ampere of current is an all fire condition. Between ¼ ampere and ½ ampere of current, the current may or may not ignite the electrical match.

The grenade system tester indicates the level of current being provided to the grenade by the grenade launching system.

SUMMARY OF THE INVENTION

The present invention is a tester for grenades which indicates that more than ½ ampere of current is available for grenade firing, that less than ¼ ampere of current is available for grenade firing, that between ¼ and ½ amperes of current is available for grenade firing and whether there is sufficient charge in the battery to operate the tester.

An objective of the present invention is to provide a grenade system tester which indicates the level of current being provided to the grenade by the grenade launching system.

Another object of the present invention is to provide a grenade system tester which indicates that more than ½ ampere of current is available for grenade firing (ensuring all fire).

Another object of the present invention is to provide a grenade system tester which indicates that less than ¼ ampere of current is available for grenade firing. (No fire condition indicates current present, but not enough to fire a grenade.)

Another object of the present invention is to provide a grenade system tester which indicates that between ¼ and ½ ampere of current is available for grenade firing. Such current may or may not fire the grenade. The tester indicates current present, but not sufficient current to ensure all fire.

Another object of the present invention is to provide a grenade launching system which is safe to use.

Another object of the present invention is to provide a grenade launching system tester which is relatively inexpensive to use.

Another object of the present invention is to provide a grenade launching system tester which is resettable.

Another object of the present invention is to provide a grenade launching system tester which permits one man operation.

A further object of the present invention is to provide a grenade launching system tester which has very low maintenance, has long life, is very rugged, is weather resistant and requires no calibration.

Other details and features of the invention will stand out from the description given below by way of non-limiting example and with reference to the accompanying drawings.

DESCRIPTION OF THE PREFERRED EMBODIMENT

Figure 1:
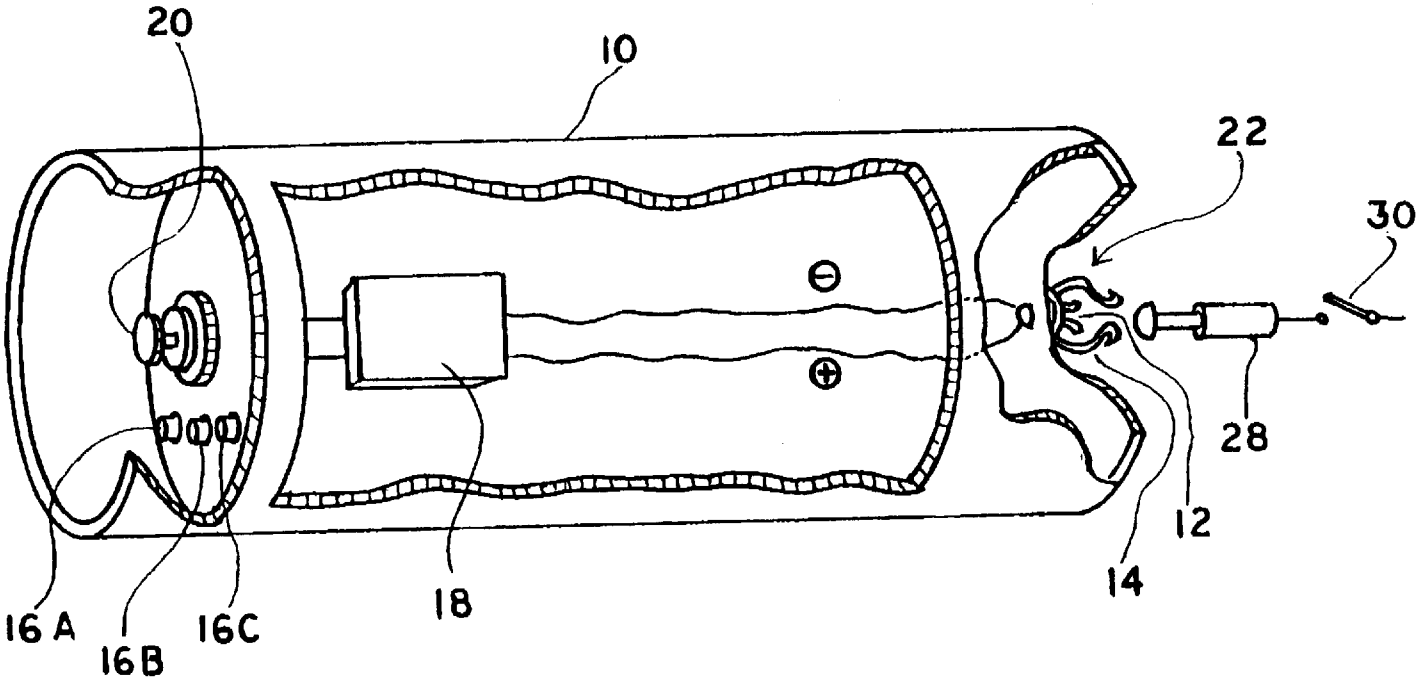
FIG. 1 is a partial cut away isometric view of the grenade launching system tester.
Figure 2:
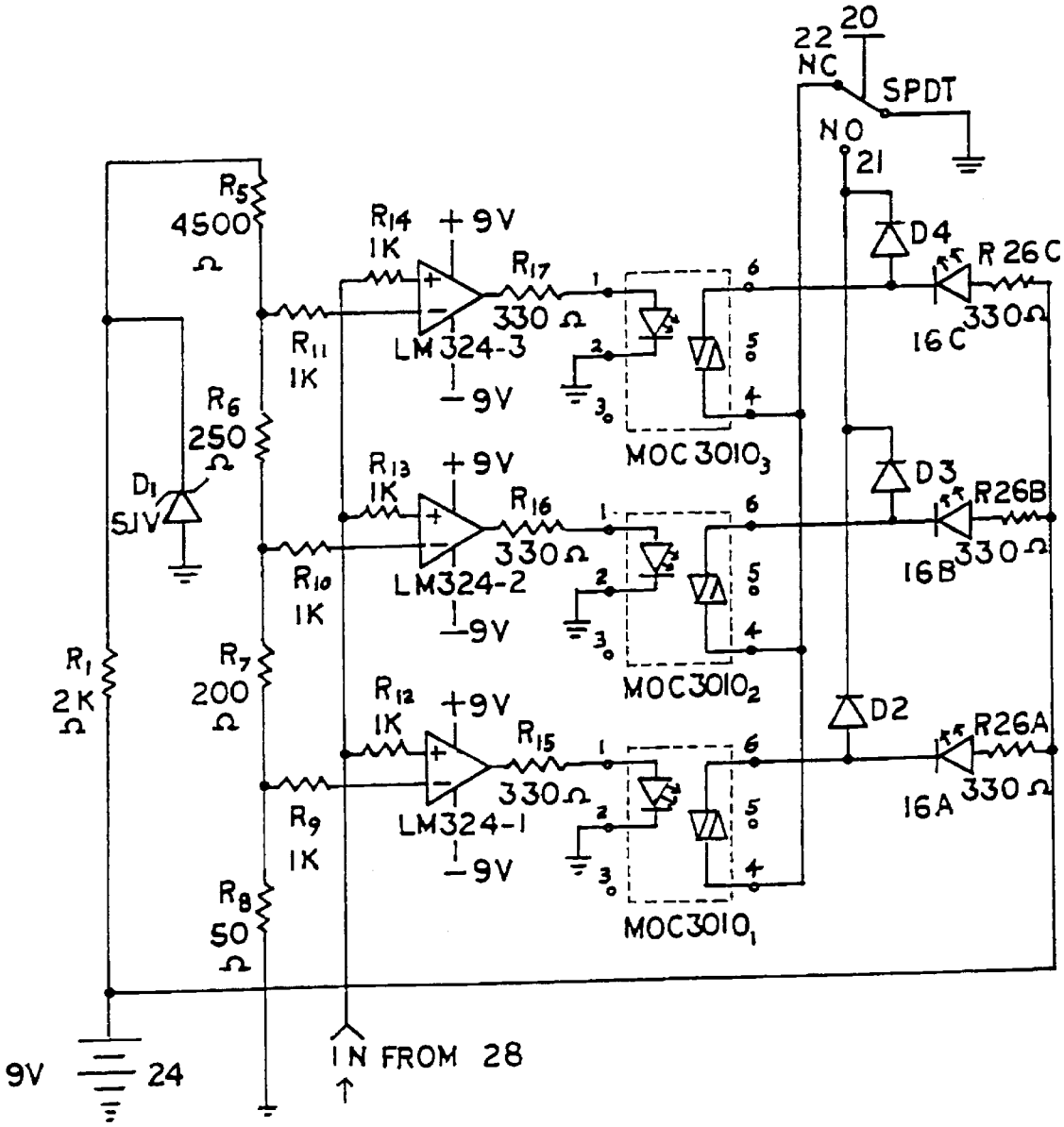
FIG. 2 is a diagrammatic view of the electrical circuit contained within the grenade launching system tester.

Referring now to FIG. 1, the tester 10 of the invention exactly duplicates the external physical characteristics of a fielded smoke screening grenade. This device has the advantage of being resettable, self checking and permitting one man operation. Since LED indicators 16*a*, 16*b*, 16*c* remain lit until reset, it is possible for one person to test the entire 80 launch tube system by oneself in 1/80th of the time it would take two people to test the system by prior art methods. A circuit board 18 to be described hereinafter, when referring to FIG. 2, is electrically connected between a single pole double throw momentary push button switch 20 and female jack 22. Another advantage of tester 10 includes very low maintenance. No tools are required to change an internal 9 volt DC battery or long life LED lights. No calibration is required. The tester is also very rugged and weather resistant.

Referring now to FIGS. 1 and 2, in operation prior to testing, the single pole double throw momentary push button switch 20, located on top of the tester 10, is operated by pushing downwardly. When the button 20 is pressed, the normally open contact 21 of the switch 20 closes, thus connecting the ground side of the 9 volt battery 24 to the cathode side of diodes $D_2$, $D_3$, and $D_4$ which in turn connects the cathode side of the light emitting diodes (LED's) 16*a*, 16*b*, 16*c*, thereby completing the circuit to the LED's 16*a*, 16*b*, 16*c* through 330 ohm current limiting resistors R26*a*, R26*b*, R26*c*. The lighting of LED's 16*a*, 16*b*, 16*c* indicates that there is sufficient charge in the 9 volt battery 24 to operate the system. When the button switch 20 is released, LED's 16*a*, 16*b* and 16*c* go out. The operator may then activate the launcher system and send a fire signal to the desired launch tubes by inserting male plug 28 of the launcher system into contacts 12 and 14 of female jack 22 and closing normally open switch 30. Contacts 14 comprise ground contacts while contacts 12 comprise hot contacts of female jack 22. In the simulation test the first signal enters the grenade system tester 10 through the female plug contacts 12 and 14 of female jack 22.

The circuit consists of the positive side of a 9VDC battery connected in series with resistor $R_i$ across the cathode of a 5.1 V zener diode D1 in order to provide a fixed supply voltage of 5VDC across a voltage divider network of resistors $R_5$, $R_6$, $R_7$, $R_8$, to thereby establish three different comparison voltages at the junctions of the voltage divider as follows: 0.05 volts at the junction of resistors $R_8$ and $R_9$ ; 0.25 volts at the junction of resistors $R_7$ and $R_{10}$; and 0.50 volts at the junction of resistors $R_6$ and $R_{11}$. The comparison voltages are applied to the negative inputs of the operational amplifiers LM324-1, LM324-2, LM324-3 through 1K resistors $R_9$, $R_{10}$, $R_{11}$. The closure of switch 30 applies the launcher firing voltage to the 'in from 28' input line shown in FIG. 2. The launcher firing voltage is applied to each of the positive inputs of the operational amplifiers LM324-1, LM324-2, LM324-3 through 1 K resistors $R_{12}$, $R_{13}$, $R_{14}$. If the launcher firing voltage is greater than 0.05 volts, LM324-1 provides an output through resistor $R_{15}$ to the input pin #1 of a 3010 opto coupler $3010_1$, causing the $3010_1$, to operate, providing a ground to the cathode of LED 16*a*, completing the circuit through R26*a* to +9VDC, causing LED 16*a* to light. As is known in the art, a 3010 coupler works by causing an infrared light-emitting diode to emit infrared radiation, which acts as a trigger for a triac, thus completing a circuit through the triac.

If the launcher firing voltage is greater than 0.25 volts, LM324-2 also operates in turn operating $3010_2$ and causing LED 16*b* to light. The no fire voltage of a smoke grenade squib or electrical match is 0.25 volts or less. If LED 16*b* is lighted then there is sufficient voltage to possibly cause grenade ignition. If the launcher firing voltage is greater than 0.5 volts, LM324-3 also operates in turn, operating $3010_3$, causing LED 16*c* to light. This would indicate an all fire condition.

Switch 20 is a single pole double throw switch which provides ground to the circuitry through its normally closed contacts 22. The 3010 IC's are so configured that once operated they will remain in that state until the circuit is broken. Operating switch 20 will remove ground from the 3010's causing them to turn off and reset.

The normally open contact of switch 20 is connected through three diodes D2, D3, D4 to the cathode side of LED's 16*a*, 16*b*, 16*c*. When switch 20 is operated it's normally open contacts close providing a ground to the three LED's causing all three to light which provides a test of all three LED's and a test of the internal 9VDC battery.

While specific embodiments of the invention have been shown and described in detail to illustrate the principles of the invention, it will be understood that the invention may be embodied otherwise without departing from such principles.

We claim:

1. A projectile grenade launching system tester for testing a projectile grenade launching system, the tester comprising:

jack means for receiving an electrical voltage provided by the projectile grenade launching system for launching a grenade;

level determining means, responsive to the electrical voltage received by the jack means, for determining whether the electrical voltage is at least equal to each of a plurality of predetermined levels, the level determining means comprising a plurality of comparing means, each for comparing the electrical voltage to a corresponding one of the predetermined levels and outputting a comparison signal indicating whether the electrical voltage is at least equal to the corresponding one of the predetermined levels; and display means, receiving the comparison signals from the plurality of comparing means, for producing a display indicative of the comparison signals.

2. The projectile grenade launching system tester as in claim 1, wherein a first one of the predetermined levels is 0.5 volts.

3. The projectile grenade launching system tester as in claim 2, wherein a second one of the predetermined levels is 0.25 volts.

4. The projectile grenade launching system tester as in claim 3, wherein a third one of the predetermined levels is 0.05 volts.

5. The projectile grenade launching system tester as in claim 1, further comprising operation testing means for determining whether the tester is operational and for controlling the display means to produce a display indicative of whether the tester is operational.

6. The projectile grenade launching system tester as in claim 1, wherein each of the comparing means comprises:

an operational amplifier receiving a first input signal indicative of the electrical voltage and a second input signal indicative of the corresponding one of the predetermined levels and outputting an amplified signal in accordance with the first and second input signals; and coupling means, receiving the amplified signal, for producing the comparison signal in accordance with the amplified signal.

7. The projectile grenade launching system tester as in claim 6, wherein:

(a) the jack means comprises:

(i) a jack for electrically connecting the tester to the projectile grenade launching system to receive the electrical voltage; and (ii) resistor means, electrically connected to the jack, for producing the first input signal for each of the operational amplifiers; and (b) the level determining means further comprises:

(i) a battery; and (ii) resistor means, electrically connected to the battery, for producing the second input signal for each of the operational amplifiers.

8. The projectile grenade launching system tester as in claim 7, wherein the coupling means of each of the comparing means comprises:

switch means for selectively completing a circuit from the battery through the display means to ground; and switch actuating means for controlling the switch means to complete the circuit only when the amplified signal has a positive value;

the comparison signal being defined as a potential drop across the circuit;

so that the comparison signal changes from zero to a non-zero value only when the amplified signal has the positive value.

9. The projectile grenade launching system tester as in claim 8, wherein:

the coupling means of each of the comparing means comprises an optical coupler in which the switch means and the switch actuating means are formed; and the display means comprises a plurality of light-emitting diodes in one-to-one correspondence with the plurality of comparing means, each of the plurality of light-emitting diodes being a part of the circuit selectively closed by the switch means of a corresponding one of the plurality of comparing means, so as to be illuminated when the comparison signal has the non-zero value.

10. The projectile grenade launching system tester as in claim 9, wherein a first one of the predetermined levels is 0.5 volts.

11. The projectile grenade launching system tester as in claim 10, wherein a second one of the predetermined levels is 0.25 volts.

12. The projectile grenade launching system tester as in claim 11, wherein a third one of the predetermined levels is 0.05 volts.

13. The projectile grenade launching system tester as in claim 9, further comprising operation testing means for determining whether the battery outputs sufficient voltage to operate the tester and for controlling the display means to produce a display indicative of whether the tester is operational, the testing means comprising a push-button switch for selectively closing a testing circuit from the battery to the plurality of light-emitting diodes to ground.

14. A method of testing a grenade launching system, the method comprising:

receiving an electrical voltage provided by the projectile grenade launching system for launching a grenade;

determining whether the electrical voltage is at least equal to each of a plurality of predetermined levels to obtain a plurality of determination results, each of the plurality of determination results indicating whether the electrical voltage is at least equal to the corresponding one of the predetermined levels; and producing a display indicative of the plurality of determination results.

15. The method as in claim 14, wherein a first one of the predetermined levels is 0.5 volts.

16. The method as in claim 15, wherein a second one of the predetermined levels is 0.25 volts.

17. The method as in claim 16, wherein a third one of the predetermined levels is 0.05 volts.

* * * * *